US006748937B2

(12) United States Patent
Soza

(10) Patent No.: US 6,748,937 B2
(45) Date of Patent: Jun. 15, 2004

(54) HALL EFFECT IGNITION SYSTEM

(76) Inventor: Lawrence E. Soza, 19328 E. Level St., Covina, CA (US) 91723

( * ) Notice: Subject to any disclaimer, the term of this patent is extended or adjusted under 35 U.S.C. 154(b) by 125 days.

(21) Appl. No.: 10/032,899

(22) Filed: Oct. 26, 2001

(65) Prior Publication Data

US 2003/0084890 A1 May 8, 2003

(51) Int. Cl.[7] ..... F02P 1/00
(52) U.S. Cl. ..... 123/594; 123/651
(58) Field of Search ..... 123/594, 651, 123/652, 595, 623, 650; 315/209 T, 209 CD

(56) References Cited

U.S. PATENT DOCUMENTS 3,592,178 A * 7/1971 Schiff ..... 123/406.66
3,639,257 A * 2/1972 Harbort ..... 427/213.3
3,666,989 A * 5/1972 Boyer ..... 315/219
3,739,759 A * 6/1973 Sleder ..... 123/598
3,815,560 A * 6/1974 Wahl et al. ..... 123/406.52
4,037,577 A 7/1977 Gallo
4,041,912 A * 8/1977 Sessions ..... 123/611
4,043,302 A * 8/1977 Sessions ..... 123/609
4,046,123 A * 9/1977 Jordan et al. ..... 123/146.5 A
4,046,124 A * 9/1977 Long ..... 123/606
4,082,075 A * 4/1978 Davis ..... 123/609
4,235,213 A 11/1980 Jellissen
4,904,903 A * 2/1990 Pacholok ..... 315/209 R
5,534,753 A * 7/1996 Blom et al. ..... 315/244
5,841,245 A * 11/1998 Blom et al. ..... 315/289

* cited by examiner

*Primary Examiner*—John Kwon
(74) *Attorney, Agent, or Firm*—Paul, Hastings, Janofsky & Walker

(57) ABSTRACT

A solid-state Hall effect ignition system which requires connection to only a single ignition coil lead wire. The lead wire connects to both an output transistor and to power supply circuitry arranged to provide an internal bias or supply voltage for the solid-state ignition circuitry. Current limiting and automatic shut-off features dwell control, and polarity protection are also provided.

34 Claims, 6 Drawing Sheets

HALL EFFECT IGNITION SYSTEM

BACKGROUND

1. Field of the Invention

The subject invention relates to ignition systems, for example, such as are used to provide timed ignition pulses to internal combustion engines.

2. Brief Description of Related Art

Today, ignition systems such as are employed with internal combustion engines in automobiles and elsewhere employ solid-state designs. Prior to the advent of solid-state ignitions, so-called breaker-point ignition systems employing a distributor were prevalent. Such breaker-point systems required frequent maintenance including tuning and replacement of points in order to maintain performance. Present solid-state systems considerably reduce the expense and inconvenience attendant to breaker-point systems.

At the same time, there remains a group of auto enthusiasts who desire to maintain authenticity of restored or collector vehicles. One aspect of such authenticity for some model vehicles is the use of a single wire exiting the distributor. In the past, solid-state ignition designs have required at least two wires to connect to the ignition coil and to supply power to the solid state componentry. In general, such solid-state ignitions have lacked features desirable for retrofitting breaker-point vehicles with solid-state componentry, as well as features desirable in various other applications.

SUMMARY

According to one aspect of the invention, a solid-state ignition is provided which features single wire operation. In various applications, only a single wire need be connected in the course of converting a prior art distributor-based ignition system to a solid-state ignition system.

BRIEF DESCRIPTION OF THE DRAWINGS

Illustrative embodiments according to the invention will now be described in conjunction with the drawings, of which.

DETAILED DESCRIPTION OF ILLUSTRATIVE EMBODIMENTS

Figure 1:
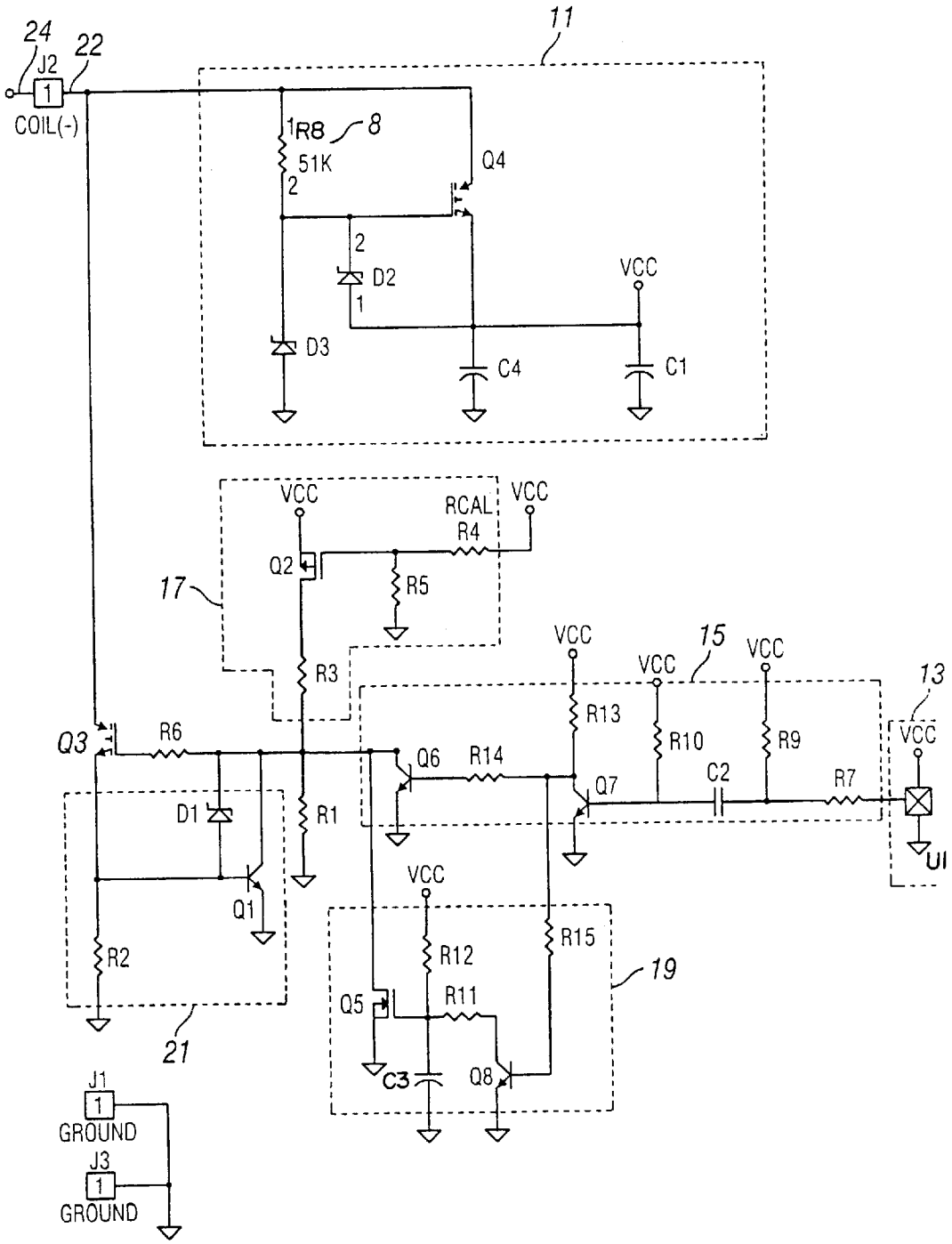
FIG. 1 is a circuit schematic of an illustrative embodiment.

FIG. 1 shows an ignition circuit according to an illustrative embodiment. As shown in FIG. 1, the illustrative embodiment may be partitioned into a number of sections:

a power supply section 11, a trigger circuit 13, a dwell control section 15, a minimum voltage control section 17, an automatic shutoff section 19, and a current limiting section 21.

The power supply section 11 includes a transistor Q4 in an emitter follower configuration. The collector of the transistor Q4 is connected to a lead 22 of an ignition coil J2, as well as to a first terminal of a resistor R8. The second terminal of the resistor R8 is connected to the gate of the transistor Q4 and to the cathode of a first zener diode D3, whose anode is connected to ground. A second zener diode D2 has its cathode connected to the gate of the transistor Q4 and its anode connected to the emitter of the transistor Q4. The emitter of the transistor Q4 is further connected to respective first terminals of respective energy storage devices, i.e. capacitors C1 and C4, whose respective second terminals are connected to ground. The power supply voltage VCC is developed across the power supply capacitor C4 and comprises an internally generated supply voltage for the ignition circuitry.

The trigger circuit 13 is comprised of a permanent magnet 23 (FIG. 13) separated from a unipolar digital hall effect sensor U1 by an air gap 25 of approximately, for example, 0.125". Trigger pulses are generated as a series of vanes pass through the air gap 25.

The dwell control section 15 includes a resistor R7 having a first terminal connected to the hall effect sensor U1 and a second terminal connected to a first terminal of a resistor R9 whose second terminal is connected to the power supply voltage VCC. A capacitor C2 is connected between the first terminal of the resistor R9 and the first terminal of a resistor R10 whose second terminal is again connected to the power supply voltage VCC.

The dwell control section 15 further includes a transistor Q7 whose base is connected to the first terminal of the resistor R10, whose emitter is grounded, and whose collector is connected through a resistor R13 to the power supply voltage VCC. The section 15 further includes a second transistor Q6 whose base is connected through resistor R14 to the collector of the first dwell control section transistor Q7. The emitter of the transistor Q6 is again grounded, while the collector of the transistor Q6 is connected to control an output transistor Q3.

The minimum voltage control section 17 includes a transistor Q2 whose source is connected to the power supply VCC and whose gate is connected to a first terminal of a resistor R5 and a first terminal of a resistor R4. The second terminals of the resistors R4, R5 are respectively connected to the power supply source VCC and ground, thereby forming a voltage divider. The drain of the transistor Q2 is connected through a resistor R3 to the collector of the transistor Q6 of the dwell control section 15.

The automatic shutoff section 19 includes a transistor Q5 whose collector is connected to the collector of the dwell control section transistor Q6, whose emitter is connected to ground. The gate of the transistor Q5 is connected to a first terminal of a resistor R12, the first terminal of a capacitor C3, and the first terminal of a resistor R11. The respective second terminals of the resistor R12 and the capacitor C3 are connected to the power supply VCC and ground, respectively. The second terminal of the resistor R11 is connected to the collector of a transistor Q8 whose emitter is grounded and whose base is connected through a resistor R15 to the collector of the transistor Q7 of the dwell control section 15.

Finally, the current limiting section 21 includes a resistor R2 connected between the emitter leg of the output transistor Q3 and ground, as well as a transistor Q1 whose base is connected to the emitter of the output transistor Q3. The base of the transistor Q1 is further connected to the anode of a zener diode D1 whose cathode is connected to a first terminal of a resistor R6, whose second terminal is, in turn, connected to the gate of the output transistor Q3. The collector of the transistor Q1 is also connected to the first terminal of the resistor R6, while the emitter of the transistor Q1 is connected to ground.

It may be noted that the transistors Q3, Q4 are logic level insulated gate bipolar transistor's which operate as voltage controlled switches, which may be turned on without significantly loading the circuit.

The operation of the illustrative embodiment will now be discussed in connection with the wave form diagrams illustrated in FIGS. 2–11.

Considering the operation of the power supply section 11, when power is applied to the circuit input 24, the transistor Q4 conducts, charging the power supply capacitor C4 to within a few volts below battery voltage. Since the device input is connected to the primary 24 of ignition coil J2, a potential of up to 400 volts is impressed on the collector of the transistor Q4 when the ignition is triggered. By using the flyback action of the ignition coil J2, the capacitor C4 is able to reach a potential greater than battery voltage. This voltage level is set by the zener diode D3, nominally 20 volts. At 20 volts, the transistor Q4 reduces conduction to maintain the setpoint voltage VCC on the capacitor C4.

As noted above, the trigger section is comprised of a permanent magnet separated from the hall effect sensor U1 by a gap of approximately 0.125". The sensor U1 is preferably a unipolar digital hall effect sensor whose output is switched on by the presence of the magnet's south magnetic field. As this field is alternately blocked and un-blocked, a series of trigger pulses are developed by the Hall sensor U1. The blocking action is preferably performed by a high permeability ferrous metal vane assembly attached to a distributor shaft, although other types of vane assemblies may be used.

Figure 2:
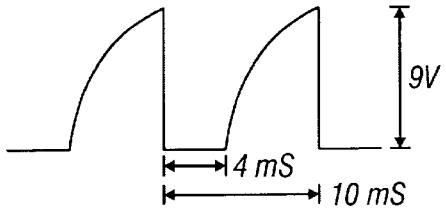
FIGS. 2–11 are waveform diagrams illustrative of operation of a circuit according to FIG. 1.
Figure 3:
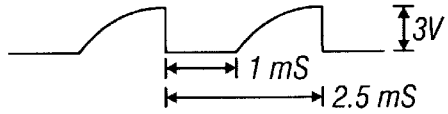

With respect to the dwell control section 15, When the output of the Hall device U1 switches "on," the capacitor C2 is discharged through the current limiting resistor R7. This discharge causes a negative going pulse to be transmitted to the base of the transistor Q7, switching transistor Q7 out of conduction. The width of the negative going pulse is proportional to frequency, becoming narrower and lower in amplitude as engine rpm is increased due to the time constant formed by the resistor R9, which permits a progressively smaller charge to be placed on the capacitor C2 as the time between successive discharges occurs. FIGS. 2 and 3 show the voltage on the capacitor C2 at the junction of R9 and C2 at 1500 rpm and 6000 rpm, respectively.

Figure 4:
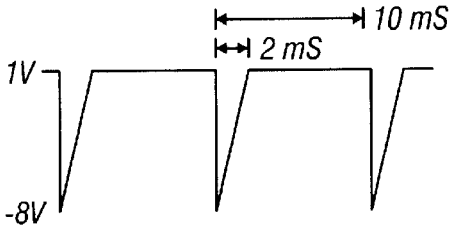
Figure 5:
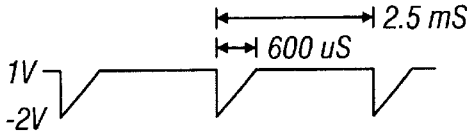
Figure 6:
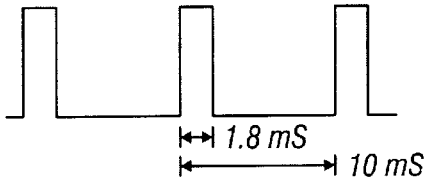
Figure 7:
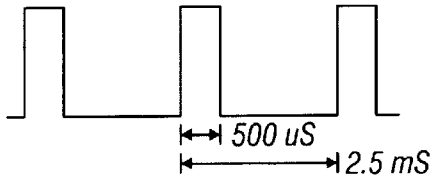
Figure 8:
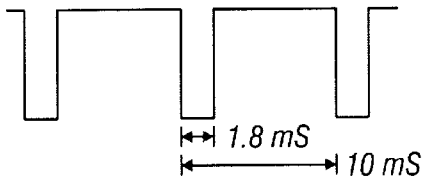
Figure 9:
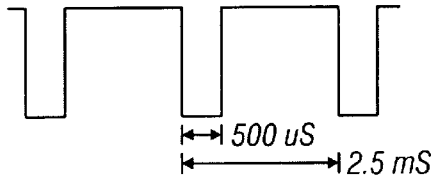

The pulse transmitted through the capacitor C2 to the base of the transistor Q7 is shown in FIGS. 4 and 5 at 1500 rpm and 6000 rpm, respectively. The rate at which this pulse decays is controlled by the resistor R10, which bleeds off the capacitor C2, forcing the transistor Q7 back into conduction. This pulse is shaped by Q7 (FIGS. 6 and 7) and inverted by the transistor Q6 for proper polarity (FIGS. 8 and 9) to control the output transistor Q3.

The minimum voltage control section 17 prevents erratic circuit operation and spurious coil discharges. To do so, the output transistor Q3 is held in a desaturated state until a system voltage VCC of, e.g., nominally 5 volts is attained. This minimum system voltage is set by the resistor divider R4 and R5 and pass transistor Q2, which provides gate drive to the output transistor Q3. In an illustrative embodiment, the value of the resistor R4 is selected to maintain minimum VCC between 4.8 and 5.2 volts.

As to the automatic shutoff section 19, the transistor Q5 is connected such that after a period determined by the time constant of the resistor R12 and the capacitor C3, the transistor Q5 will turn on and remove the gate drive from the output transistor Q3. In the illustrative embodiment, this action takes place approximately one-quarter (0.25) second after the cessation of trigger pulses from device U1. Upon resumption of trigger pulses, the transistor Q8 discharges the capacitor C3 and removes gate drive from the transistor Q5, allowing output transistor Q3 to function.

Figure 10:
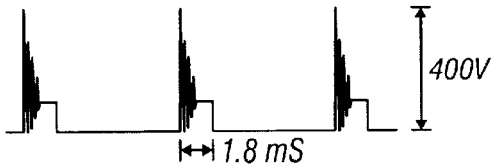
Figure 11:
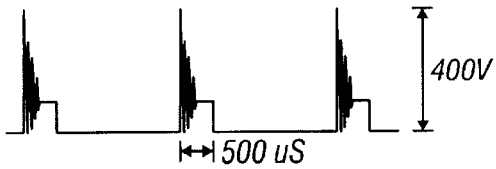

Finally, with respect to the current limiting section 21, the resistor R2 is placed in the emitter leg of output transistor Q3 to sense emitter current. In the illustrative embodiment, upon reaching approximately 6 amps, sufficient voltage is developed across the resistor R2 to bias the transistor Q1 on, removing gate drive from output transistor Q3. This action causes current in Q3 to settle at an equilibrium value (about 6 amps) and prevents any additional increase in current. FIGS. 10 and 11 show the final output waveform at the coil primary negative 22 at 1500 rpm and 6000 rpm, respectively.

The following Table contains illustrative components for implementing a circuit such as that shown in FIG. 1. It will be appreciated that the types and values of components set forth are illustrative only. Many and diverse values, types, and combinations of values and types of components may be used in various embodiments to implement methods and apparatus as claimed below.

| COMPONENT | |
|---|---|
| | VALUE (KΩ) |
| R1 | 100K |
| R3 | 10 |
| R4 | 51 |
| R5 | 51 |
| R8 | 51 |
| R9 | 100 |
| R10 | 51 |
| R12 | $3.3 \times 10^3$ |
| R13 | 10 |
| R14 | 10 |
| R15 | 10 |
| | VALUE (Ω) |
| $R_2$ | .10 (2 watt) |
| R7 | 100 |
| R11 | 100 |
| R6 | 47 |
| | VALUE (μf) |
| C1 | .1 |
| C2 | .1 |
| C3 | .22 |
| C4 | 68 |
| | VALUE (Volts) |
| D1 | 5.6 |
| D2 | 5.6 |
| D3 | 20 |
| | TYPE |
| Q1, $Q_6$, $Q_7$, Q8 | MMBT 3904, 40 V, 200 ma, NPN |
| $Q_5$ | 2N7002, 60 V, 115 ma, N-ch MOSFET |
| $Q_2$ | B5584, 50 V, 130 ma, P-ch MOSFET |
| $Q_3$, $Q_4$ | HGTP14N403VL, 400 V, 14 A, N-ch IGBT |

Figure 12:
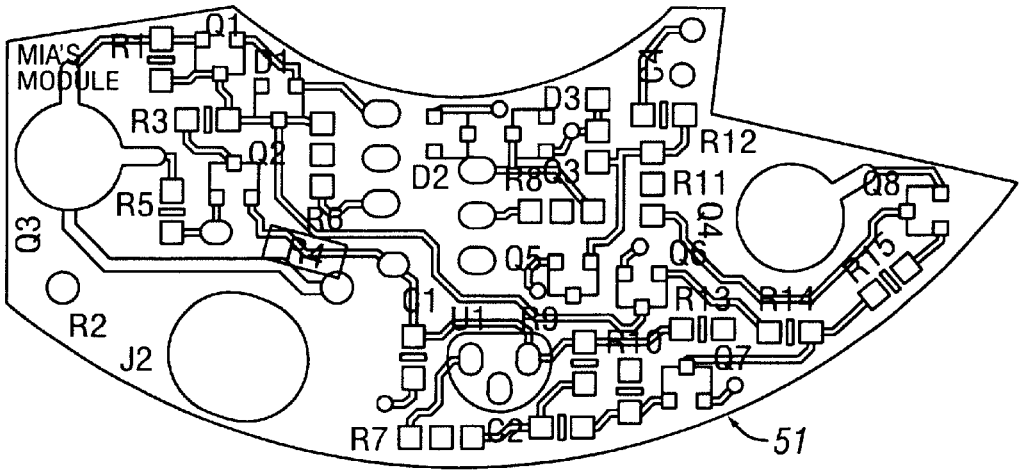
FIG. 12 is a PCB fabrication drawing illustrative of a modular implementation of the circuit of FIG. 1.

FIG. 12 illustrates an example of a printed circuit board layout 51 of componentry such as shown in FIG. 1. Such a layout 51 may be fabricated according to conventional procedures well-known in the art.

Figure 13:
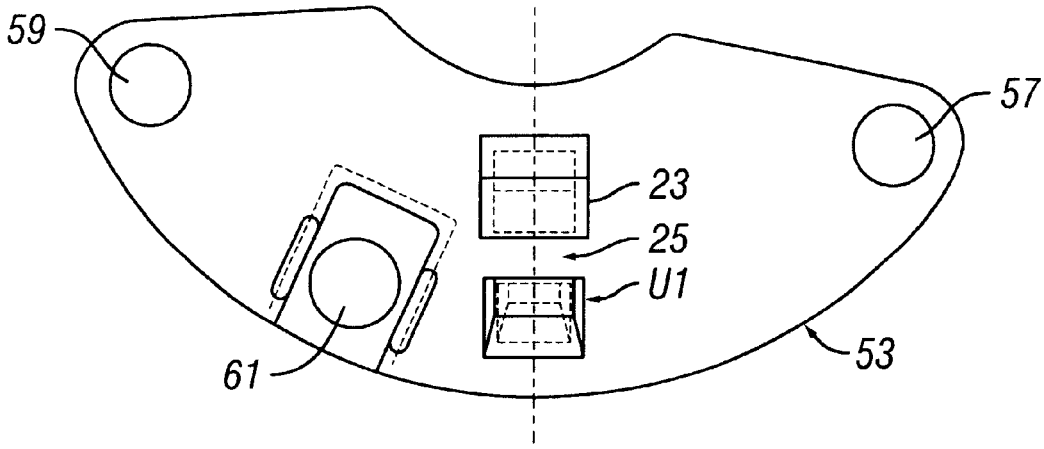
FIG. 13 illustrates a top view of a housing for encasing a PCB board laid out as in FIG. 12.
Figure 14:
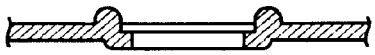
FIG. 14 is a sectional view taken at B&B of FIG. 13.
Figure 15:
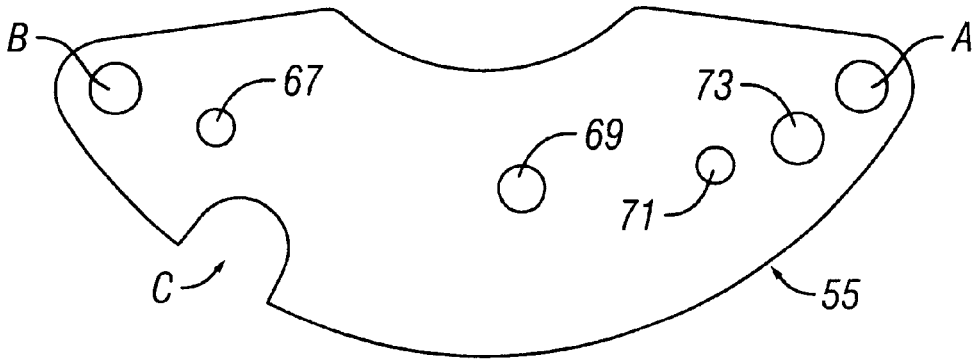
FIG. 15 is a bottom view of a base plate for closing the housing of FIG. 14.
Figure 16:
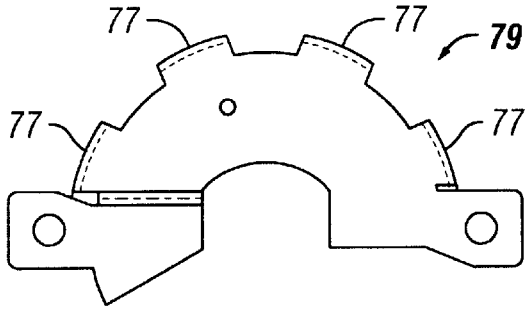
FIGS. 16–18 illustrate a rotor assembly for use in a Hall effect application.
Figure 17:
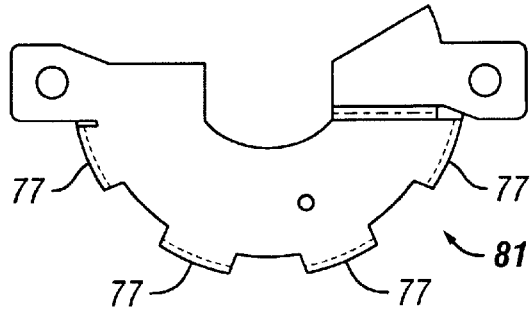
Figure 18:
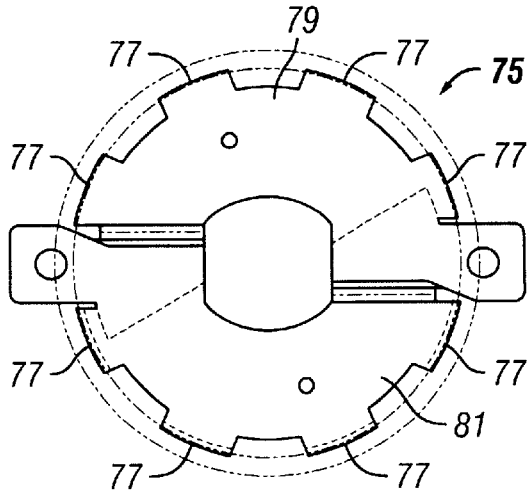

FIGS. 13–15 illustrate a housing 53 and a base plate 55 for enclosing a printed circuit board, e.g., 51, to create a Hall effect ignition signal generation module, sometimes referred to simply as a "module." As noted above, the housing 53 includes an encased Hall effect sensor U1 and an encased magnet 23 separated by an air gap 25. The housing 53 further includes cylindrical holes 57, 59 for insertion of fastening devices, as well as a recessed opening 61 adapted to establish an electrical connection to a single ignition coil lead wire, preferably providing electrical contact to the negative side 22 of the ignition coil J2. The particular opening 26 illustrated includes parallel side ridges to assist in retaining a "spade" type electrical connector. The opening 61 may provide for insertion of a threaded device such as a screw to positively attach such a connector.

The housing 53 may be hollow and of a uniform thickness so as to enclose and surround the PCB 51 and so as to permit closing on its underside by a generally conductive metal base plate 55. (FIG. 15) The housing 53, when enclosed by the plate 55, forms a "module" according to one embodiment.

The plate 55 includes circular openings 63, 65 concentric with holes 57, 59, as well as four additional circular openings 67, 69, 71, 73. Opening 69 provides a recess for the point set pivot. Openings 67, 71 provide mounting for Q3 & Q4 respectively, as well as circuit ground connection. Opening 73 is an epoxy filling hole. Openings A, B are mounting holes, while opening C is a cutout useful for dual point distributor applications. In a retrofit application, the base plate 55 preferably is formed of an electrically conductive material in order to establish electrical connection (ground) to a point plate 79 (FIG. 19) of prior art breaker-point distributor 81 (FIGS. 19, 20).

FIGS. 16–19 illustrate a typical rotor assembly 75 providing a plurality of depending rectangular vanes 77 for activating the Hall effect trigger circuit of FIG. 1. The particular rotor assembly includes two halves 79, 81, which provide for ease of assembly about a distributor shaft in various applications.

From the foregoing, it will be appreciated that in steady state operation, the output transistor Q3 is normally "on," pulling coil current. Turning the transistor Q3 off breaks the circuit and thus has the effect of the points opening thereby generating a spark across the gap of a cooperating spark plug. When the circuit is initially turned "on," (e.g., the key is turned on, connecting battery voltage to the primary of the coil J2), the transistor Q3 wants to turn "on," which would ground the circuit and prevent the capacitor C4 of the power supply 11 from ever charging. Thus, resistors R4 and R5 are provided to force the transistor Q3 to stay off until VCC reaches 5 volts. VCC ramps up slowly and is thus stabilized at 5 volts before the transistor Q3 is pulsed via a trigger signal. If the transistor Q3 settled into equilibrium at 5 volts, it would be destroyed by excessive current. Accordingly, the network including the transistor Q5 is further provided to pull the transistor Q3 out of saturation after a time interval determined by C3/R11. In steady state operation, the transistor Q3 is pulsed at a frequency which prevents the transistor Q5 from operating.

Figure 19:
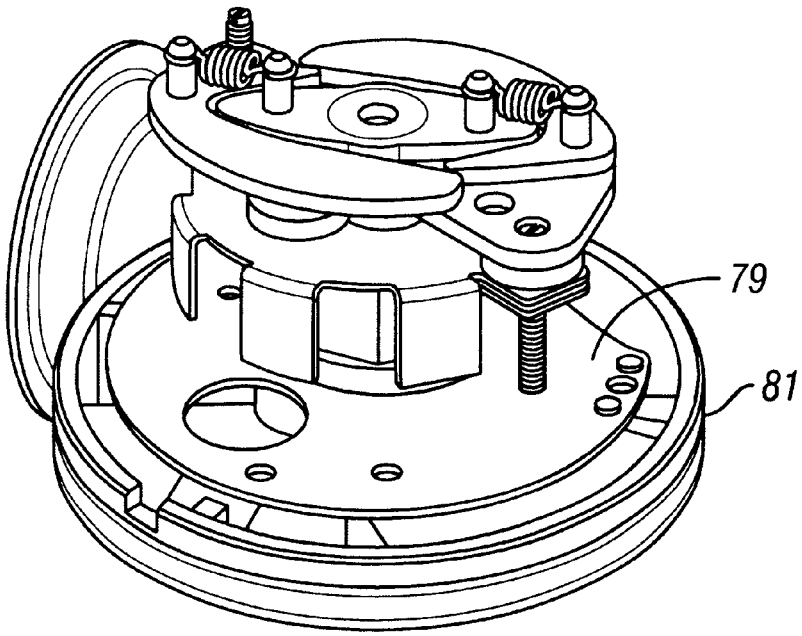
FIGS. 19 and 20 are perspective views illustrating a retrofit application of a apparatus employing apparatus according to FIGS. 1–18.
Figure 20:
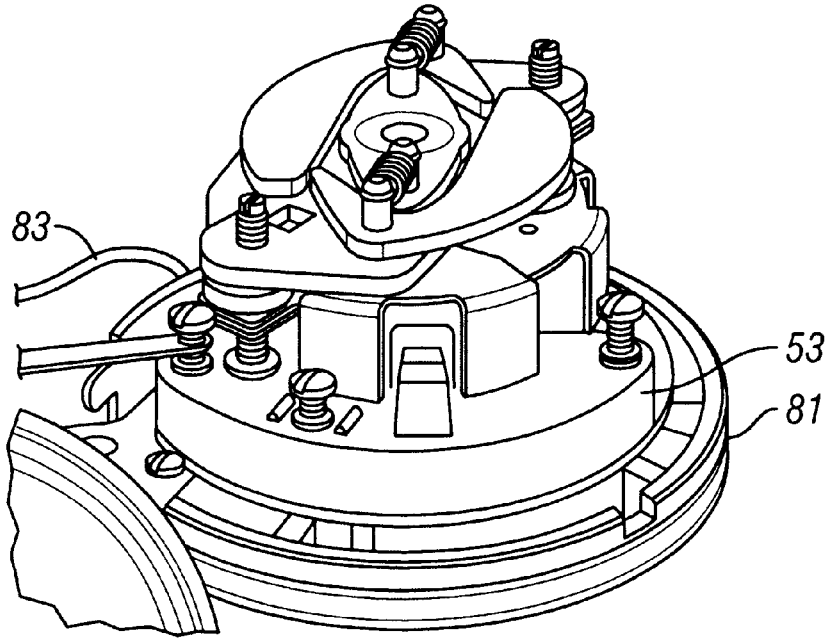

FIGS. 19 and 20 illustrate simple one wire hook-up achievable by connecting an original points wire 83 to the module. Such a hook-up may be used to convert engines originally equipped with breaker-points and windowed style distributor caps to a solid-state electronic ignition. By utilizing a fully integrated trigger and power module, the entire ignition fits completely inside the distributor 81. The result is a state-of-the-art ignition with an absolutely stock appearance. Various features achievable individually and in combination through implementation of the illustrative and other embodiments include:

- Single wire operation to preserve stock appearance while simplifying wiring.
- Active dwell control to maintain high rpm spark energy while reducing coil heating at idle.
- Auto-standby protection against coil damage or dead battery should the ignition accidentally be left on.
- Hall Effect rotary-vane sensor design which compensates for worn bearings and distributor end play. A magnetic sensor is unaffected by oil, dirt or other contaminants, unlike optical systems. Embodiments employing optical generation of trigger signals may, of course, be used without departing from the scope of the invention.
- Over-voltage/over-current protected against damage from high amp battery chargers, reversed battery, or improper wiring.
- A sealed, hi-temp thermoplastic housing is preferred and provides exceptional resistance against moisture and vibration.
- No distributor modification, or removal is required in various embodiments.

While the present invention has been described above in terms of specific embodiments, it is to be understood that the invention is not limited to the disclosed embodiments. For example, and not by way of limitation, a functional circuit may be implemented while omitting one or more of the current limiting circuit 21, auto shut-off circuit 10 and/or dwell control circuit 15. The minimum voltage circuit 17 may be implemented using a zener diode or similar breakover device rather than a MOSFET and calibration resistors. The power supply IGBT $Q_4$ may be replaced by a MOSFET and a diode placed between the anode of the zener $D_2$ and the capacitor $C_4$. Thus, the scope of the present invention extends to various modifications and equivalent methods and structures included within the spirit and scope of the appended claims.

What is claimed is:

1. A method of generating an ignition signal comprising:

providing a solid-state ignition pulse train generation circuit; and generating a power supply for said circuit utilizing a single connection to an ignition coil lead wire.

2. The method of claim 1 wherein said solid-state circuit comprises a Hall effect ignition pulse train generation circuit.

3. The method of claim 1 further comprising the step of preventing spurious coil discharges during initial start-up of said circuit.

4. The method of claim 3 wherein said step of generating comprises developing a voltage from energy derived from said single connection and wherein said step of preventing spurious discharges comprises the step of maintaining an output transistor of said circuit in a desaturated state until a selected voltage level is developed.

5. The method of claim 4 further including the step of limiting the amount of current through said output transistor to a selected amount.

6. The method of claim 5 wherein said circuit comprises a Hall effect ignition pulse train generation circuit and further including the step of shutting off said transistor after a selected interval during which no Hall effect trigger pulses are generated.

7. A method of generating an ignition signal comprising the steps of:

providing a solid-state ignition pulse train generation circuit; and generating a power supply for said circuit by storing energy derived from an ignition coil lead wire.

8. The method of claim 7 wherein said energy is stored by circuitry comprising a capacitor.

9. The method of claim 7 wherein said solid-state circuit comprises a Hall effect ignition pulse train generation circuit.

10. The method of claim 7 further comprising the step of preventing spurious coil discharges during initial start-up of said circuit.

11. The method of claim 10 wherein said step of preventing spurious coil discharges comprises the step of maintaining an output transistor of said circuit in a desaturated state until a selected voltage is developed.

12. The method of claim 7 wherein said power supply comprises a voltage.

13. The method of claim 12 wherein said voltage is a bias voltage.

14. The method of claim 13 wherein said bias voltage is developed across an energy storage device.

15. The method of claim 14 wherein said energy storage device comprises a capacitor.

16. The method of claim 10 wherein said step of generating comprises developing a voltage from energy derived from said single connection and wherein said step of preventing spurious discharges comprises the step of maintaining an output transistor of said circuit in a desaturated state until a selected voltage level is developed.

17. The method of claim 16 further including the step of limiting the amount of current through said output transistor to a selected amount.

18. The method of claim 17 wherein said step of limiting comprises turning off said output transistor when the current therethrough reaches a selected value.

19. The method of claim 18 wherein said circuit comprises a Hall effect ignition pulse train generation circuit and further including the step of shutting off said output transistor after a selected interval during which no Hall effect trigger pulses are generated by said circuit.

20. The method of claim 7 further including the step of limiting the amount of current through an output transistor of said circuit to a selected amount.

21. The method of claim 20 wherein said step of limiting comprises turning off said output transistor when the circuit therethrough reaches a selected value.

22. The method of claim 9 further including the step of shutting off said output transistor after a selected interval during which no Hall effect trigger pulses are generated.

23. The method of claim 22 further comprising disabling operation of said pulse train generation circuit during initial start-up thereof.

24. The method of claim 7 further comprising disabling operation of said pulse train generation circuit during initial start-up thereof.

25. The method of claim 1 wherein said step of generating comprises developing a voltage from energy derived from said single connection.

26. The method of claim 1 further comprising the step of disabling operation of said pulse train generation circuit during initial start-up thereof.

27. The method of claim 6 further comprising the step of disabling operation of said pulse train generation circuit during initial start-up thereof.

28. The method of claim 5 wherein said step of limiting comprises turning off said output transistor when the current therethrough reaches a selected value.

29. The method of claim 1 further including the step of limiting the amount of current through an output transistor of said circuit to a selected amount.

30. The method of claim 29 wherein said step of limiting comprises turning off said output transistor when the current therethrough reaches a selected value.

31. The method of claim 2 further including the step of shutting off an output transistor of said circuit after a selected interval during which no Hall effect trigger pulses are generated.

32. The method of claim 25 wherein said voltage is a bias voltage.

33. The method of claim 32 wherein said bias voltage is developed across a capacitor.

34. A method of generating an ignition signal comprising:

providing a solid-state Hall effect ignition pulse train generation circuit; and generating a power supply for said circuit utilizing a single connection to an ignition coil lead wire.

* * * * *